US011300295B2

(12) United States Patent
Benjamin et al.

(10) Patent No.: US 11,300,295 B2
(45) **Date of Patent: *Apr. 12, 2022**

(54) FUEL NOZZLE STRUCTURE FOR AIR ASSIST INJECTION

(71) Applicant: General Electric Company, Schenectady, NY (US)

(72) Inventors: Michael Anthony Benjamin, Cincinnati, OH (US); Joshua Tyler Mook, Loveland, OH (US); Sean James Henderson, Bellbrook, OH (US); Ramon Martinez, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 166 days.

This patent is subject to a terminal disclaimer.

(21) Appl. No.: 16/586,016

(22) Filed: Sep. 27, 2019

(65) Prior Publication Data

US 2020/0041128 A1 Feb. 6, 2020

Related U.S. Application Data

(62) Division of application No. 15/107,282, filed as application No. PCT/US2014/072023 on Dec. 23, 2014, now Pat. No. 10,451,282.
(Continued)

(51) Int. Cl.
*F23R 3/28* (2006.01)
*F23R 3/14* (2006.01)
(Continued)

(52) U.S. Cl.
CPC ..... *F23R 3/283* (2013.01); *F23R 3/286* (2013.01); *F23D 11/386* (2013.01);
(Continued)

(58) Field of Classification Search
CPC ..... F23R 3/283; F23R 3/286; F23R 3/343; F23R 2900/00004; F23R 3/34;
(Continued)

(56) References Cited

U.S. PATENT DOCUMENTS 1,908,066 A 5/1933 Sedlmeir
3,258,838 A 7/1966 Tilton, Jr.
(Continued)

FOREIGN PATENT DOCUMENTS

CN 104803344 A 7/2015
EP 1471308 B1 6/2008
(Continued)

OTHER PUBLICATIONS

Canadian office action for application 2,933,539 dated Feb. 3, 2021 (3 pages).

*Primary Examiner* — Stephanie Sebasco Cheng
(74) *Attorney, Agent, or Firm* — Dinsmore & Shohl LLP

(57) ABSTRACT

A fuel nozzle apparatus includes: an outer body having an exterior surface and a plurality of openings in the exterior surface. An inner body is disposed inside the outer body, cooperating with the outer body to define an annular space. A main injection ring is disposed in the annular space and includes an array of fuel posts extending outward therefrom, each fuel post including a perimeter wall defining a lateral surface and a recessed floor. Each fuel post is aligned with one of the openings and separated from the opening by a perimeter gap defined between the opening and the lateral surface. A main fuel gallery extends within the main injection ring. The main injection ring includes plurality of main fuel orifices, each main fuel orifice communicating with the main fuel gallery and extending through one of the fuel posts.

13 Claims, 4 Drawing Sheets

Related U.S. Application Data

(60) Provisional application No. 61/920,002, filed on Dec. 23, 13.

(51) Int. Cl.
*F23R 3/34* (2006.01)
*F23D 11/38* (2006.01)

(52) U.S. Cl.
CPC ..... *F23D 2209/30* (2013.01); *F23R 3/14* (2013.01); *F23R 3/34* (2013.01); *F23R 3/346* (2013.01); *F23R 2900/00004* (2013.01)

(58) Field of Classification Search
CPC ..... F23R 3/28–36; F23D 2209/30; F23D 11/386; F23D 11/24; F23D 11/38; F05D 2260/601
See application file for complete search history.

(56) References Cited

U.S. PATENT DOCUMENTS

| | | | | |
|---|---|---|---|---|
| 3,291,191 | A | 12/1966 | Stoops | |
| 3,301,650 | A | 1/1967 | Ward | |
| 3,480,416 | A | 11/1969 | Stoops | |
| 3,656,222 | A | 4/1972 | Jones | |
| 3,672,032 | A | 6/1972 | Witherspoon | |
| 3,684,186 | A | 8/1972 | Helmrich | |
| 3,707,750 | A | 1/1973 | Klass | |
| 3,837,198 | A | 9/1974 | Higgins | |
| 3,909,157 | A | 9/1975 | Wachtell | |
| 4,085,717 | A | 4/1978 | Willmann | |
| 4,088,437 | A | 5/1978 | Holzapfel | |
| 4,216,652 | A | 8/1980 | Herman | |
| 4,273,070 | A | 6/1981 | Hoefelmayr | |
| 4,327,547 | A | 5/1982 | Hughes | |
| 4,425,755 | A | 1/1984 | Hughes | |
| 4,461,323 | A | 7/1984 | Morikawa | |
| 4,582,093 | A | 4/1986 | Hubbard | |
| 4,584,834 | A | 4/1986 | Koshoffer | |
| 4,609,150 | A | 9/1986 | Pane, Jr. | |
| 4,610,320 | A | 9/1986 | Beakley | |
| 4,674,167 | A | 6/1987 | Hubbard | |
| 4,722,559 | A | 2/1988 | Bongartz | |
| 5,038,014 | A | 8/1991 | Pratt | |
| 5,057,073 | A | 10/1991 | Martin | |
| 5,062,205 | A | 11/1991 | Fraser | |
| 5,097,666 | A | 3/1992 | Shekleton | |
| 5,117,637 | A | 6/1992 | Howell | |
| 5,197,191 | A | 3/1993 | Dunkman | |
| 5,220,786 | A | 6/1993 | Campbell | |
| 5,270,926 | A | 12/1993 | Tam | |
| 5,297,215 | A | 3/1994 | Yamagishi | |
| 5,309,709 | A | 5/1994 | Cederwall | |
| 5,321,947 | A | 6/1994 | Sood | |
| 5,321,951 | A | 6/1994 | Falls | |
| 5,329,761 | A | 7/1994 | Ablett | |
| 5,474,419 | A | 12/1995 | Reluzco | |
| 5,501,840 | A | 3/1996 | Mantovani | |
| 5,673,552 | A | 10/1997 | Idleman | |
| 5,713,205 | A | 2/1998 | Sciocchetti | |
| 5,715,167 | A | 2/1998 | Gupta | |
| 5,761,907 | A | 6/1998 | Pelletier | |
| 5,794,601 | A | 8/1998 | Pantone | |
| 5,824,250 | A | 10/1998 | Whalen | |
| 5,836,163 | A | 11/1998 | Lockyer | |
| 5,963,314 | A | 10/1999 | Worster | |
| 5,988,531 | A | 11/1999 | Maden | |
| 5,993,731 | A | 11/1999 | Jech | |
| 6,003,756 | A | 12/1999 | Rhodes | |
| 6,032,457 | A | 3/2000 | McKinney | |
| 6,041,132 | A | 3/2000 | Isaacs | |
| 6,068,330 | A | 5/2000 | Kasuga | |
| 6,134,780 | A | 10/2000 | Coughlan | |
| 6,144,008 | A | 11/2000 | Rabinovich | |
| 6,227,801 | B1 | 5/2001 | Liu | |
| 6,256,995 | B1 | 7/2001 | Sampath | |
| 6,283,162 | B1 | 9/2001 | Butler | |
| 6,354,072 | B1 | 3/2002 | Hura | |
| 6,355,086 | B2 | 3/2002 | Brown | |
| 6,363,726 | B1 | 4/2002 | Durbin | |
| 6,453,660 | B1 | 9/2002 | Johnson et al. | |
| 6,898,926 | B2 * | 5/2005 | Mancini | F23R 3/343 60/39.094 |
| 6,898,938 | B2 * | 5/2005 | Mancini | F23R 3/286 60/748 |
| 6,959,535 | B2 * | 11/2005 | Mancini | F23K 5/18 60/39.094 |
| 8,806,871 | B2 | 8/2014 | McMasters | |
| 8,935,911 | B2 * | 1/2015 | Nonaka | F23R 3/283 60/39.094 |
| 9,453,461 | B2 * | 9/2016 | Patel | F23R 3/346 |
| 10,001,281 | B2 | 6/2018 | Patel | |
| 2007/0028617 | A1 * | 2/2007 | Hsieh | F23R 3/14 60/737 |
| 2007/0028618 | A1 * | 2/2007 | Hsiao | F23R 3/343 60/737 |
| 2007/0028624 | A1 * | 2/2007 | Hsieh | F23R 3/286 60/776 |
| 2007/0119177 | A1 | 5/2007 | McMasters | |
| 2007/0163114 | A1 | 7/2007 | Johnson | |
| 2009/0113893 | A1 | 5/2009 | Li | |
| 2009/0256007 | A1 | 10/2009 | McMasters | |
| 2010/0251719 | A1 * | 10/2010 | Mancini | F23R 3/286 60/737 |
| 2010/0263382 | A1 * | 10/2010 | Mancini | F23R 3/28 60/742 |
| 2011/0259976 | A1 | 10/2011 | Tyler | |
| 2015/0316265 | A1 | 11/2015 | Dolmansley | |
| 2015/0316267 | A1 * | 11/2015 | Dolmansley | F23D 11/108 60/776 |
| 2017/0003030 | A1 | 1/2017 | Benjamin et al. | |

FOREIGN PATENT DOCUMENTS

| | | | |
|---|---|---|---|
| EP | 3087321 | B1 | 11/2016 |
| JP | 2007146697 | A | 6/2007 |
| JP | 2007155318 | A | 6/2007 |
| JP | 2011520055 | A | 7/2011 |
| JP | 2012132672 | A | 7/2012 |
| WO | 2008129350 | A1 | 10/2008 |
| WO | 2009126701 | A2 | 10/2009 |

* cited by examiner

FUEL NOZZLE STRUCTURE FOR AIR ASSIST INJECTION

BACKGROUND

Embodiments of present invention relates to gas turbine engine fuel nozzles and, more particularly, to an apparatus for draining and purging gas turbine engine fuel nozzles.

Aircraft gas turbine engines include a combustor in which fuel is burned to input heat to the engine cycle. Typical combustors incorporate one or more fuel injectors whose function is to introduce liquid fuel into an air flow stream so that it can atomize and burn.

Staged combustors have been developed to operate with low pollution, high efficiency, low cost, high engine output, and good engine operability. In a staged combustor, the nozzles of the combustor are operable to selectively inject fuel through two or more discrete stages, each stage being defined by individual fuel flowpaths within the fuel nozzle. For example, the fuel nozzle may include a pilot stage that operates continuously, and a main stage that only operates at higher engine power levels. The fuel flowrate may also be variable within each of the stages.

The main stage includes an annular main injection ring having a plurality of fuel injection ports which discharge fuel through a surrounding centerbody into a swirling mixer airstream. A need with this type of fuel nozzle is to make sure that fuel is not ingested into voids within the fuel nozzle where it could ignite causing internal damage and possibly erratic operation.

BRIEF DESCRIPTION OF THE INVENTION

This need is addressed by the embodiments of the present invention, which provides a fuel nozzle incorporating an injection structure configured to generate an airflow that purges and assists penetration of a fuel stream into a high velocity airstream.

According to one aspect of the invention, a fuel nozzle apparatus includes: an annular outer body, the outer body extending parallel to a centerline axis, the outer body having a generally cylindrical exterior surface extending between forward and aft ends, and having a plurality of openings passing through the exterior surface; an annular inner body disposed inside the outer body, cooperating with the outer body to define an annular space; an annular main injection ring disposed inside the annular space, the main injection ring including an annular array of fuel posts extending radially outward therefrom; each fuel post being aligned with one of the openings in the outer body and separated from the opening by a perimeter gap which communicates with the annular space, wherein each fuel post includes a perimeter wall defining a cylindrical lateral surface and a radially-outward-facing floor recessed radially inward from a distal end surface of the perimeter wall to define a spray well; and the perimeter gap is defined between the opening and the lateral surface; a main fuel gallery extending within the main injection ring in a circumferential direction; and a plurality of main fuel orifices, each main fuel orifice communicating with the main fuel gallery and extending through one of the fuel posts.

According to another aspect of the invention, a fuel nozzle apparatus includes: an annular outer body, the outer body extending parallel to a centerline axis, the outer body having a generally cylindrical exterior surface extending between forward and aft ends, and having a plurality of openings passing through the exterior surface, wherein each opening communicates with a conical well inlet formed on an inner surface of the outer body; an annular inner body disposed inside the outer body, cooperating with the outer body to define an annular space; an annular main injection ring disposed inside the annular space, the main injection ring including an annular array of fuel posts extending radially outward therefrom; each fuel post being aligned with one of the openings in the outer body and separated from the opening by a perimeter gap which communicates with the annular space, wherein each fuel post is frustoconical in shape and includes a conical lateral surface and a planar, radially-facing outer surface, wherein the perimeter gap is defined between the well inlet and the lateral surface; a main fuel gallery extending within the main injection ring in a circumferential direction; and a plurality of main fuel orifices, each main fuel orifice communicating with the main fuel gallery and extending through one of the fuel posts.

BRIEF DESCRIPTION OF THE DRAWINGS

Embodiments of the present invention may be best understood by reference to the following description, taken in conjunction with the accompanying drawing figures in which.

DETAILED DESCRIPTION

Generally, embodiments of the present invention provides a fuel nozzle with an injection ring. The main injection ring incorporates an injection structure configured to generate an airflow through a controlled gap surrounding a fuel orifice that flows fuel from the main injection ring, and assists penetration of a fuel stream from the fuel orifice into a high velocity airstream.

Figure 1:
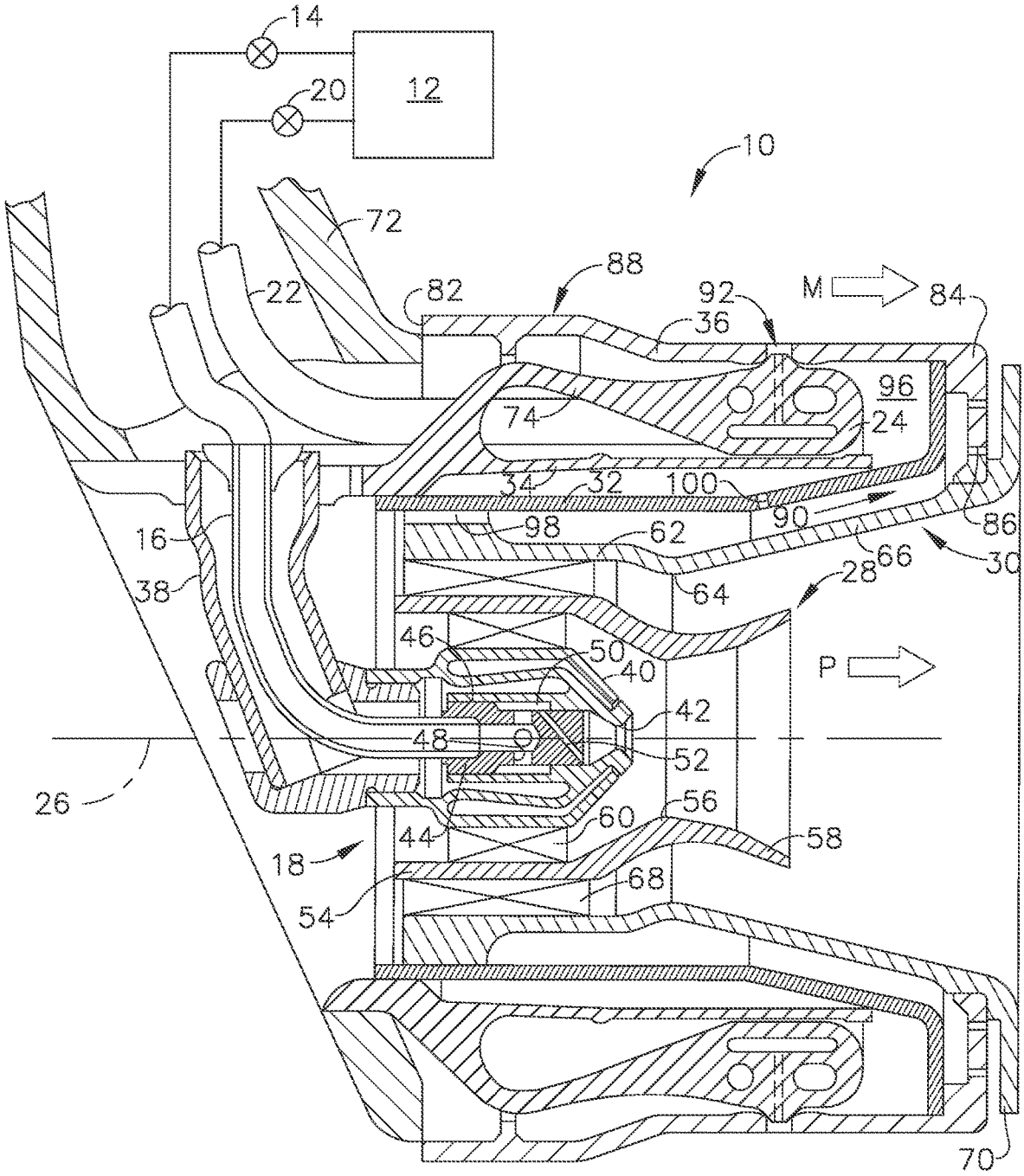
FIG. 1 is a schematic cross-sectional view of a gas turbine engine fuel nozzle constructed according to an aspect of the present invention.

Now, referring to the drawings wherein identical reference numerals denote the same elements throughout the various views, FIG. 1 depicts an exemplary of a fuel nozzle 10 of a type configured to inject liquid hydrocarbon fuel into an airflow stream of a gas turbine engine combustor (not shown). The fuel nozzle 10 is of a "staged" type meaning it is operable to selectively inject fuel through two or more discrete stages, each stage being defined by individual fuel flowpaths within the fuel nozzle 10. The fuel flowrate may also be variable within each of the stages.

The fuel nozzle 10 is connected to a fuel system 12 of a known type, operable to supply a flow of liquid fuel at varying flowrates according to operational need. The fuel system supplies fuel to a pilot control valve 14 which is coupled to a pilot fuel conduit 16, which in turn supplies fuel to a pilot 18 of the fuel nozzle 10. The fuel system 12 also supplies fuel to a main valve 20 which is coupled to a main fuel conduit 22, which in turn supplies a main injection ring 24 of the fuel nozzle 10.

For purposes of description, reference will be made to a centerline axis 26 of the fuel nozzle 10 which is generally parallel to a centerline axis of the engine (not shown) in which the fuel nozzle 10 would be used. The major components of the illustrated fuel nozzle 10 are disposed extending parallel to and surrounding the centerline axis 26, generally as a series of concentric rings. Starting from the centerline axis 26 and proceeding radially outward, the major components are: the pilot 18, a splitter 28, a venturi 30, an inner body 32, a main ring support 34, the main injection ring 24, and an outer body 36. Each of these structures will be described in detail.

The pilot 18 is disposed at an upstream end of the fuel nozzle 10, aligned with the centerline axis 26 and surrounded by a fairing 38.

The illustrated pilot 18 includes a generally cylindrical, axially-elongated, pilot centerbody 40. An upstream end of the pilot centerbody 40 is connected to the fairing 38. The downstream end of the pilot centerbody 40 includes a converging-diverging discharge orifice 42 with a conical exit.

A metering plug 44 is disposed within a central bore 46 of the pilot centerbody 40 The metering plug 44 communicates with the pilot fuel conduit. The metering plug 44 includes transfer holes 48 that flow fuel to a feed annulus 50 defined between the metering plug 44 and the central bore 46, and also includes an array of angled spray holes 52 arranged to receive fuel from the feed annulus 50 and flow it towards the discharge orifice 42 in a swirling pattern, with a tangential velocity component.

The annular splitter 28 surrounds the pilot injector 18. It includes, in axial sequence: a generally cylindrical upstream section 54, a throat 56 of minimum diameter, and a downstream diverging section 58.

An inner air swirler includes a radial array of inner swirl vanes 60 which extend between the pilot centerbody 40 and the upstream section 54 of the splitter 28. The inner swirl vanes 60 are shaped and oriented to induce a swirl into air flow passing through the inner air swirler.

The annular venturi 30 surrounds the splitter 28. It includes, in axial sequence: a generally cylindrical upstream section 62, a throat 64 of minimum diameter, and a downstream diverging section 66. A radial array of outer swirl vanes 68 defining an outer air swirler extends between the splitter 28 and the venturi 30. The outer swirl vanes 68, splitter 28, and inner swirl vanes 60 physically support the pilot 18. The outer swirl vanes 68 are shaped and oriented to induce a swirl into air flow passing through the outer air swirler. The bore of the venturi 30 defines a flowpath for a pilot air flow, generally designated "P", through the fuel nozzle 10. A heat shield 70 in the form of an annular, radially-extending plate may be disposed at an aft end of the diverging section 66. A thermal barrier coating (TBC) (not shown) of a known type may be applied on the surface of the heat shield 70 and/or the diverging section 66.

The annular inner body 32 surrounds the venturi 30 and serves as a radiant heat shield as well as other functions described below.

The annular main ring support 34 surrounds the inner body 32. The main ring support 34 may be connected to the fairing 38 and serve as a mechanical connection between the main injection ring 24 and stationary mounting structure such as a fuel nozzle stem, a portion of which is shown as item 72.

The main injection ring 24 which is annular in form surrounds the venturi 30. It may be connected to the main ring support 34 by one or more main support arms 74.

The main injection ring 24 includes a main fuel gallery 76 extending in a circumferential direction (see FIG. 2) which is coupled to and supplied with fuel by the main fuel conduit 22. A radial array of main fuel orifices 78 formed in the main injection ring 24 communicate with the main fuel gallery 76. During engine operation, fuel is discharged through the main fuel orifices 78. Running through the main injection ring 24 closely adjacent to the main fuel gallery 76 are one or more pilot fuel galleries 80. During engine operation, fuel constantly circulates through the pilot fuel galleries 80 to cool the main injection ring 24 and prevent coking of the main fuel gallery 76 and the main fuel orifices 78.

The annular outer body 36 surrounds the main injection ring 24, venturi 30, and pilot 18, and defines the outer extent of the fuel nozzle 10. A forward end 82 of the outer body 36 is joined to the stem 72 when assembled (see FIG. 1). An aft end of the outer body 36 may include an annular, radially-extending baffle 84 incorporating cooling holes 86 directed at the heat shield 70. Extending between the forward and aft ends is a generally cylindrical exterior surface 88 which in operation is exposed to a mixer airflow, generally designated "M." The outer body 36 defines a secondary flowpath 90, in cooperation with the venturi 30 and the inner body 32. Air passing through this secondary flowpath 90 is discharged through the cooling holes 86.

The outer body 36 includes an annular array of recesses referred to as "spray wells" 92. Each of the spray wells 92 is defined by an opening 94 in the outer body 36 in cooperation with the main injection ring 24. Each of the main fuel orifices 78 is aligned with one of the spray wells 92.

The outer body 36 and the inner body 32 cooperate to define an annular tertiary space or void 96 protected from the surrounding, external air flow. The main injection ring 24 is contained in this void. Within the fuel nozzle 10, a flowpath is provided for the tip air stream to communicate with and supply the void 96 a minimal flow needed to maintain a small pressure margin above the external pressure at locations near the spray wells 92. In the illustrated example, this flow is provided by small supply slots 98 and supply holes 100 disposed in the venturi 30 and the inner body 32, respectively.

The fuel nozzle 10 and its constituent components may be constructed from one or more metallic alloys. Nonlimiting examples of suitable alloys include nickel and cobalt-based alloys.

All or part of the fuel nozzle 10 or portions thereof may be part of a single unitary, one-piece, or monolithic component, and may be manufactured using a manufacturing process which involves layer-by-layer construction or additive fabrication (as opposed to material removal as with conventional machining processes). Such processes may be referred to as "rapid manufacturing processes" and/or "additive manufacturing processes," with the term "additive manufacturing process" being the term used herein to refer generally to such processes. Additive manufacturing processes include, but are not limited to: Direct Metal Laser Melting (DMLM), Laser Net Shape Manufacturing (LNSM), electron beam sintering, Selective Laser Sintering (SLS), 3D printing, such as by inkjets and laserjets, Stereolithography (SLS), Electron Beam Melting (EBM), Laser Engineered Net Shaping (LENS), and Direct Metal Deposition (DMD).

Figure 3:
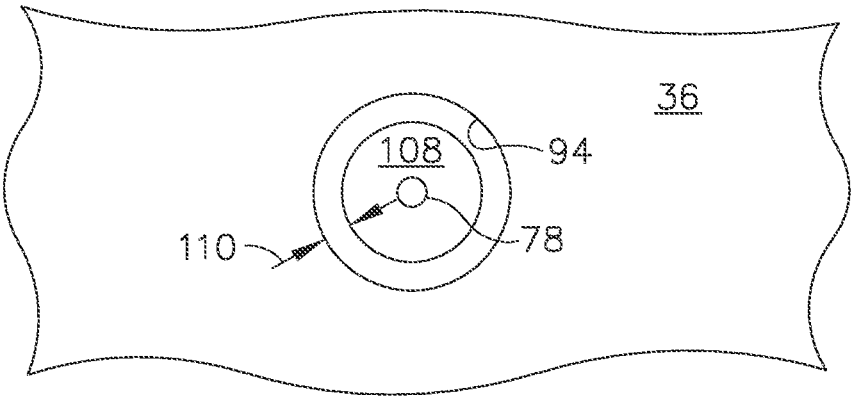
FIG. 3 is a top plan view of the fuel injection structure shown in FIG. 2.
Figure 2:
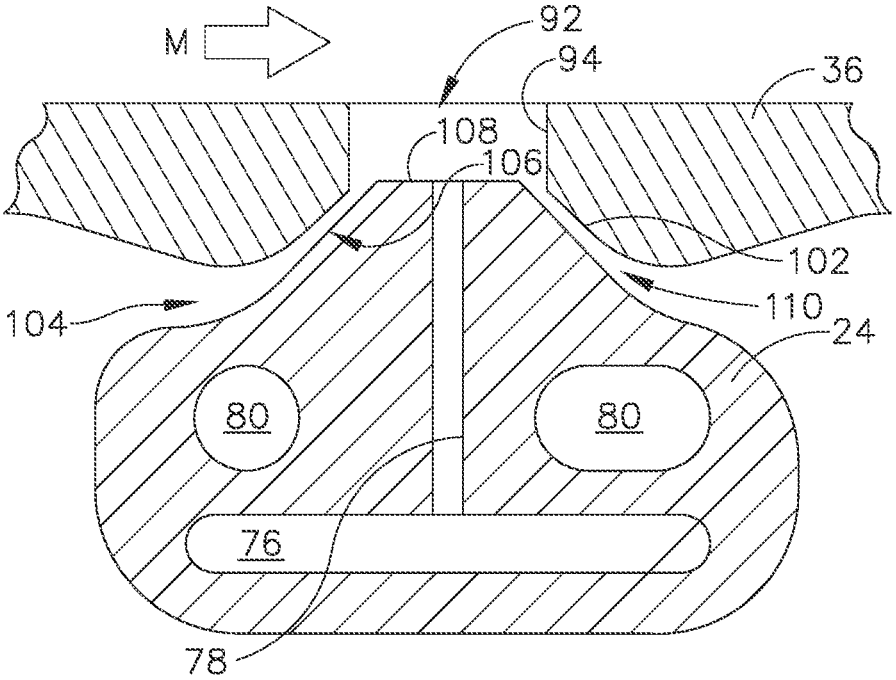
FIG. 2 is an enlarged view of a portion of the fuel nozzle of FIG. 1, showing a main fuel injection structure thereof.

The main injection ring 24, main fuel orifices 78, and spray wells 92 may be configured to provide a controlled secondary purge air path and an air assist at the main fuel orifices 78. Referring to FIGS. 2 and 3, the openings 94 are generally cylindrical and oriented in a radial direction. Each opening 94 communicates with a conical well inlet 102 formed in the wall of the outer body 36. As shown in FIG. 3, the local wall thickness of the outer body 36 adjacent the openings 94 may be increased to provide thickness to define the well inlet 102.

The main injection ring 24 includes a plurality of raised fuel posts 104 extending radially outward therefrom. The fuel posts 104 are frustoconical in shape and include a conical lateral surface 106 and a planar, radially-facing outer surface 108. Each fuel post 104 is aligned with one of the openings 94. Together, the opening 94 and the associated fuel post 104 define one of the spray wells 92. The fuel post 104 is positioned to define an annular gap 110 in cooperation with the associated conical well inlet 102. One of the main fuel orifices 78 passes through each of the fuel posts 104, exiting through the outer surface 108.

These small controlled gaps 110 around the fuel posts 104 serve two purposes. First, the narrow passages permit minimal purge air to flow through to protect the internal tip space or void 96 from fuel ingress. Second, the air flow exiting the gaps 110 provides an air-assist to facilitate penetration of fuel flowing from the main fuel orifices 78 through the spray wells 92 and into the local, high velocity mixer airstream M.

Figure 5:
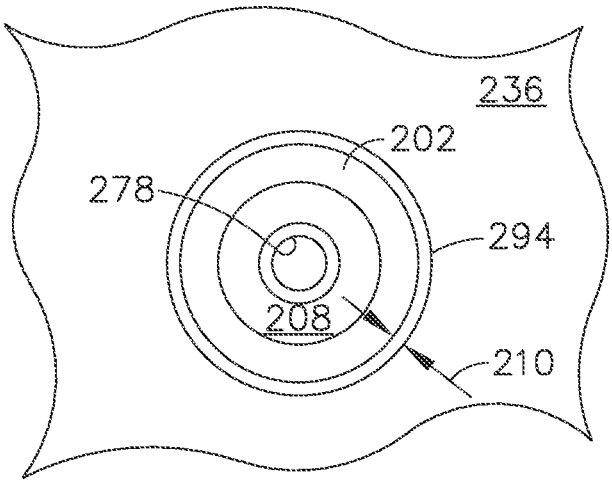
FIG. 5 is a top plan view of the fuel injection structure shown in FIG. 4.
Figure 4:
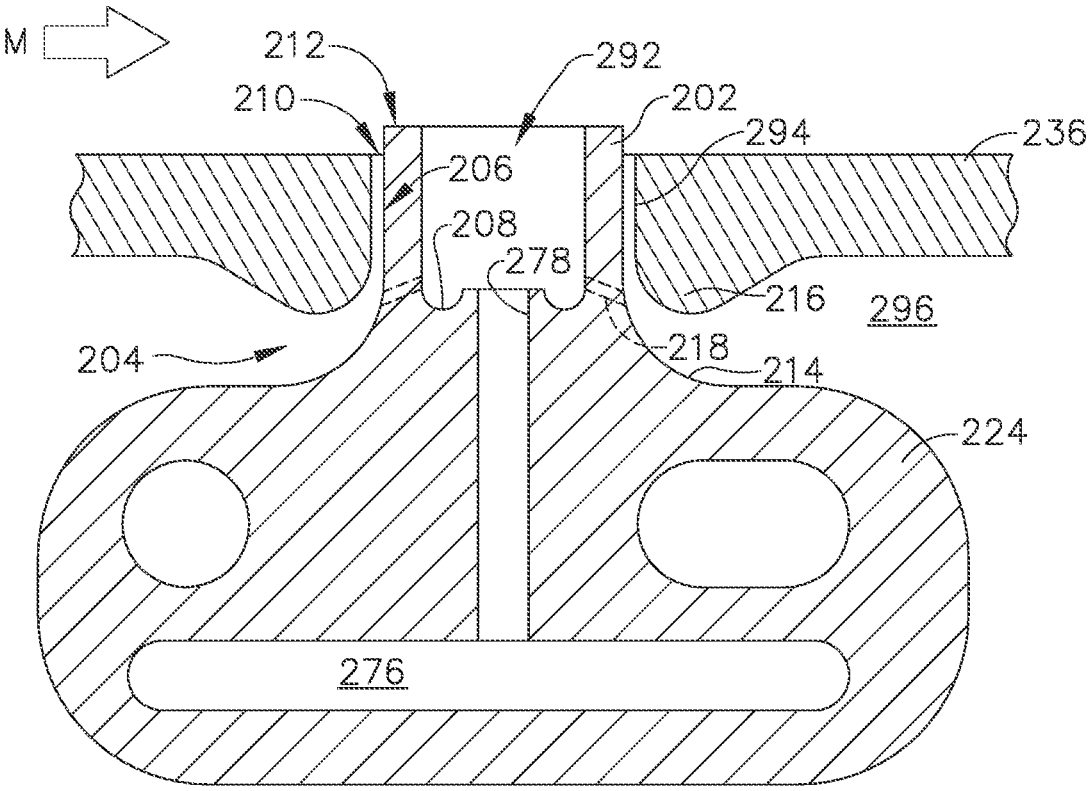
FIG. 4 is a sectional view of a portion of a fuel nozzle, showing an alternative main fuel injection structure.

FIGS. 4 and 5 illustrate an alternative configuration for providing controlled purge air exit and injection air assist. Specifically, these figures illustrate a portion of a main injection ring 224 and an outer body 236 which may be substituted for the main injection ring 24 and outer body 36 described above. Any structures or features of the main injection ring 224 and the outer body 236 that are not specifically described herein may be assumed to be identical to the main injection ring 24 and outer body 36 described above. The outer body 236 includes an annular array of openings 294 which are generally cylindrical and oriented in a radial direction.

The main injection ring 224 includes a plurality of raised fuel posts 204 extending radially outward therefrom. The fuel posts 204 include a perimeter wall 202 defining a cylindrical lateral surface 206. A radially-facing floor 208 is recessed from a distal end surface 212 of the perimeter wall 202, and in combination with the perimeter wall 202, defines a spray well 292. Each of the main fuel orifices 278 communicates with a main fuel gallery 276 and passes through one of the fuel posts 204, exiting through the floor 208 of the fuel post 204. Each fuel post 204 is aligned with one of the openings 294 and is positioned to define an annular gap 210 in cooperation with the associated opening 294. These small controlled gaps 210 around the fuel posts 204 permit minimal purge air to flow through to protect internal tip space or void 296 from fuel ingress. The base 214 of the fuel post 204 may be configured with an annular concave fillet, and the wall of the outer body 236 may include an annular convex-curved fillet 216 at the opening 294. By providing smooth turning and area reduction of the inlet passage this configuration promotes even distribution and maximum attainable velocity of purge airflow through the annular gap 210.

One or more small-diameter assist ports 218 are formed through the perimeter wall 202 of each fuel post 204 near its intersection with the floor 208 of the main injection ring 224. Air flow passing through the assist ports 218 provides an air-assist to facilitate penetration of fuel flowing from the main fuel orifices 278 through the spray wells 292 and into the local, high velocity mixer airstream M.

Figure 7:
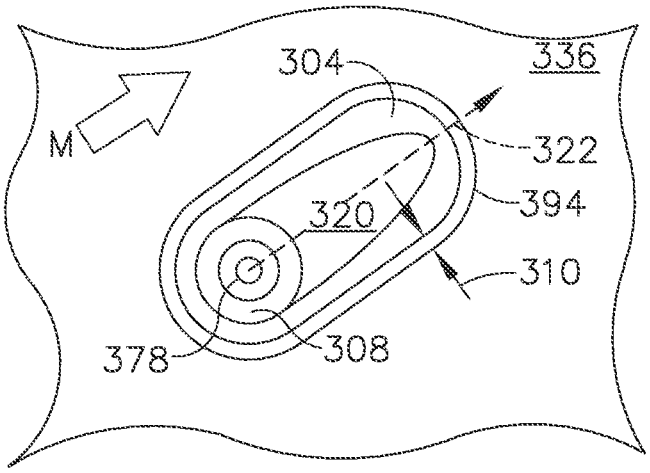
FIG. 7 is a top plan view of the fuel injection structure shown in FIG. 6.
Figure 6:
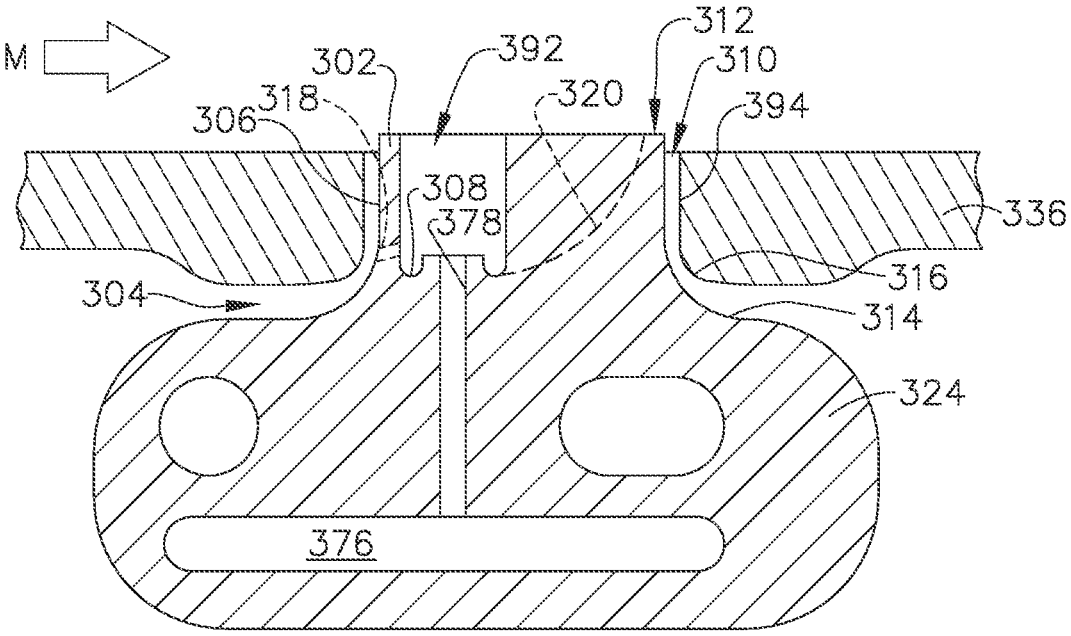
FIG. 6 is a sectional view of a portion of a fuel nozzle, showing an alternative main fuel injection structure.

FIGS. 6 and 7 illustrate another alternative configuration for providing controlled purge air exit and injection air assist. Specifically, these figures illustrate a portion of a main injection ring 324 and an outer body 336 which may be substituted for the main injection ring 24 and outer body 36 described above. Any structures or features of the main injection ring 324 and the outer body 336 that are not specifically described herein may be assumed to be identical to the main injection ring 24 and outer body 36 described above. The outer body 336 includes an annular array of openings 394 which are generally elongated in plan view. They may be oval, elliptical, or another elongated shape. In the specific example illustrated they are "racetrack-shaped". As used herein the term "racetrack-shaped" means a shape including two straight parallel sides connected by semi-circular ends.

The main injection ring 324 includes a plurality of raised fuel posts 304 extending radially outward therefrom. The fuel posts 304 include a perimeter wall 302 defining a lateral surface 306. In plan view the fuel posts 304 are elongated and may be, for example, oval, elliptical, or racetrack-shaped as illustrated. A circular bore is formed in the fuel post 304, defining a floor 308 recessed from a distal end surface 312 of the perimeter wall 302, and in combination with the perimeter wall 302, defines a spray well 392. Each of the main fuel orifices 378 communicates with a main fuel gallery 376 and passes through one of the fuel posts 304, exiting through the floor 308 of the fuel post 304. Each fuel post 304 is aligned with one of the openings 394 and is positioned to define a perimeter gap 310 in cooperation with the associated opening 394. These small controlled gaps 310 around the fuel posts 304 permit minimal purge air to flow through to protect internal tip space from fuel ingress. The base 314 of the fuel post 304 may be configured with an annular concave fillet, and the wall of the outer body 336 may include a thickened portion 316 which may be shaped into a convex-curved fillet at the opening 394. by providing smooth turning and area reduction of the inlet passage this configuration promotes even distribution and high velocity of purge airflow through the perimeter gap 310.

One or more small-diameter assist ports 318 are formed through the perimeter wall 302 of each fuel post 304 near its intersection with the floor 308 of the main injection ring 324. Air flow passing through the assist ports 318 provides an air-assist to facilitate penetration of fuel flowing from the main fuel ports 378 through the spray wells 392 and into the local, high velocity mixer airstream M.

The elongated shape of the fuel posts 304 provides surface area so that the distal end surface 312 of one or more of the fuel posts 304 can be configured to incorporate a ramp-shaped "scarf." The scarfs can be arranged to generate local static pressure differences between adjacent main fuel orifices 378. These local static pressure differences between adjacent main fuel orifices 378 may be used to purge stagnant main fuel from the main injection ring 324 during periods of pilot-only operation as to avoid main circuit coking.

When viewed in cross-section as seen in FIG. 6, the scarf 320 has its greatest or maximum radial depth (measured relative to the distal end surface 312) at its interface with the associated spray well 392 and ramps or tapers outward in radial height, joining the distal end surface 312 at some distance away from the spray well 392. In plan view, as seen in FIG. 7, the scarf 320 extends away from the main fuel port 378 along a line 322 parallel to the distal end surface 312 and tapers in lateral width to a minimum width at its distal end. The direction that the line 322 extends defines the orientation of the scarf 320. The scarf 320 shown in FIG. 7 is referred to as a "downstream" scarf, as it is parallel to a streamline of the rotating or swirling mixer airflow M and has its distal end located downstream from the associated main fuel orifice 378 relative to the mixer airflow M.

The presence or absence of the scarf 320 and orientation of the scarf 320 determines the static air pressure present at the associated main fuel orifice 378 during engine operation. The mixer airflow M exhibits "swirl," that is, its velocity has both axial and tangential components relative to the centerline axis 26. To achieve the purge function mentioned above, the spray wells 392 may be arranged such that different ones of the main fuel orifices 378 are exposed to different static pressures during engine operation. For example, each of the main fuel orifices 378 not associated with a scarf 320 would be exposed to the generally prevailing static pressure in the mixer airflow M. For purposes of description these are referred to herein as "neutral pressure ports." Each of the main fuel orifices 378 associated with a "downstream" scarf 320 as seen in FIG. 7 would be exposed to reduced static pressure relative to the prevailing static pressure in the mixer airflow M. For purposes of description these are referred to herein as "low pressure ports." While not shown, it is also possible that one or more scarfs 320 could be oriented opposite to the orientation of the downstream scarfs 320. These would be "upstream scarfs" and the associated main fuel orifices 378 would be exposed to increased static pressure relative to the prevailing static pressure in the mixer airflow M. For purposes of description these are referred to herein as "high pressure ports."

The main fuel orifices 378 and scarfs 320 may be arranged in any configuration that will generate a pressure differential effective to drive a purging function. For example, positive pressure ports could alternate with neutral pressure ports, or positive pressure ports could alternate with negative pressure ports.

The embodiments of the present invention described above may have several benefits. The embodiments provide a means to prevent voids within a fuel nozzle from ingesting fuel and to assist fuel penetration into an airstream.

The foregoing has described a main injection structure for a gas turbine engine fuel nozzle. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A fuel nozzle apparatus, comprising:

an annular outer body, the annular outer body extending parallel to a centerline axis, the annular outer body having a cylindrical exterior surface extending between a forward end and an aft end, and having a plurality of openings passing through the cylindrical exterior surface;

an annular inner body disposed inside the annular outer body, cooperating with the annular outer body to define an annular space;

an annular main injection ring disposed inside the annular space, the annular main injection ring including an annular array of fuel posts extending radially outward from a radially outer surface of the annular main injection ring;

each fuel post of the annular array of fuel posts being aligned with a respective one of the plurality of openings in the annular outer body and separated from the respective one of the plurality of openings by a perimeter gap which communicates with the annular space, wherein each fuel post of the annular array of fuel posts includes a perimeter wall defining a cylindrical lateral surface, and a radially-outward-facing floor recessed radially inward from a distal end surface of the perimeter wall, the radially-outward-facing floor recessed radially inward by a first radial distance that is less than a second radial distance between the distal end surface of the perimeter wall and the radially outer surface of the annular main injection ring, the perimeter wall having an outer diameter greater than an outer diameter of the radially-outward-facing floor, and each perimeter gap is defined between the respective one of the plurality of openings and the cylindrical lateral surface of the respective fuel post of the annular array of fuel posts;

a main fuel gallery extending within the annular main injection ring in a circumferential direction; and a plurality of main fuel orifices, each of the plurality of main fuel orifices communicating with the main fuel gallery and extending through one of the fuel posts of the annular array of fuel posts to the respective radially-outward-facing floor.

2. The apparatus of claim 1, wherein each fuel post of the annular array of fuel posts extends radially outward beyond the cylindrical exterior surface of the annular outer body.

3. The apparatus of claim 1, wherein a concave fillet is disposed at a junction of a fuel post of the annular array of fuel posts and the annular main injection ring.

4. The apparatus of claim 1, wherein a convex-curved fillet is formed in the annular outer body, the convex-curved fillet adjoining an opening of the plurality of openings.

5. The apparatus of claim 1, wherein an assist port is formed in the perimeter wall of a fuel post of the annular array of fuel posts at an intersection of the perimeter wall with the radially-outward-facing floor of the fuel post.

6. The apparatus of claim 1, further including:

an annular venturi including a throat of minimum diameter, the throat disposed inside the annular inner body;

an annular splitter disposed inside the annular venturi;

an array of outer swirl vanes extending between the annular venturi and the annular splitter;

a pilot fuel injector disposed within the annular splitter; and an array of inner swirl vanes extending between the annular splitter and the pilot fuel injector.

7. The apparatus of claim 6, further comprising:

a fuel system operable to supply a flow of liquid fuel at varying flowrates;

a pilot fuel conduit coupled between the fuel system and the pilot fuel injector; and a main fuel conduit coupled between the fuel system and the annular main injection ring.

8. A fuel nozzle apparatus, comprising:

an annular outer body, the annular outer body extending parallel to a centerline axis, the annular outer body having a cylindrical exterior surface extending between a forward end and an aft end, and having a plurality of openings passing through the cylindrical exterior surface;

an annular inner body disposed inside the annular outer body, cooperating with the annular outer body to define an annular space;

an annular main injection ring disposed inside the annular space, the annular main injection ring including an annular array of fuel posts extending radially outward from a radially outer surface of the annular main injection ring;

each fuel post of the annular array of fuel posts being aligned with a respective one of the plurality of openings in the annular outer body and separated from the respective one of the plurality of openings by a perimeter gap which communicates with the annular space, wherein each fuel post of the annular array of fuel posts includes a perimeter wall defining a cylindrical lateral surface, and a radially-outward-facing floor recessed radially inward from a distal end surface of the perimeter wall to define a spray well, the radially-outward-facing floor recessed radially inward by a first radial distance that is less than a second radial distance between the distal end surface of the perimeter wall and the radially outer surface of the annular main injection ring, the perimeter wall having an outer diameter greater than an outer diameter of the radially-outward-facing floor, and each perimeter gap is defined between the respective one of the plurality of openings and the cylindrical lateral surface of the respective fuel post of the annular array of fuel posts;

a main fuel gallery extending within the annular main injection ring in a circumferential direction; and a plurality of main fuel orifices, each of the plurality of main fuel orifices communicating with the main fuel gallery and extending through one of the fuel posts of the annular array of fuel posts to the respective radially-outward-facing floor, each of the plurality of main fuel orifices in direct fluid communication with each spray well.

9. The apparatus of claim 8, wherein each fuel post of the annular array of fuel posts extends radially outward beyond the cylindrical exterior surface of the annular outer body.

10. The apparatus of claim 8, wherein a concave fillet is disposed at a junction of a fuel post of the annular array of fuel posts and the annular main injection ring.

11. The apparatus of claim 8, wherein a convex-curved fillet is formed in the annular outer body, the convex-curved fillet adjoining an opening of the plurality of openings.

12. The apparatus of claim 8, wherein an assist port is formed in the perimeter wall of a fuel post of the annular array of fuel posts at an intersection of the perimeter wall with the radially-outward-facing floor of the fuel post.

13. The apparatus of claim 8, further including:

an annular venturi including a throat of minimum diameter, the throat disposed inside the annular inner body;

an annular splitter disposed inside the annular venturi;

an array of outer swirl vanes extending between the annular venturi and the annular splitter;

a pilot fuel injector disposed within the annular splitter; and an array of inner swirl vanes extending between the annular splitter and the pilot fuel injector.

* * * * *